US008393079B2

(12) United States Patent
Parmer

(10) Patent No.: US 8,393,079 B2
(45) Date of Patent: Mar. 12, 2013

(54) HANDLING SPINE FIN COILS, WINDERS, REELS, SHAPERS AND/OR PROCESSING SPINE FIN AND TRANSITION TUBE SPLICING AND REWORK

(76) Inventor: Mark Anthony Parmer, Tyler, TX (US)

( * ) Notice: Subject to any disclaimer, the term of this patent is extended or adjusted under 35 U.S.C. 154(b) by 807 days.

(21) Appl. No.: 12/606,086

(22) Filed: Oct. 26, 2009

(65) Prior Publication Data

US 2010/0101089 A1 Apr. 29, 2010

Related U.S. Application Data

(60) Provisional application No. 61/108,070, filed on Oct. 24, 2008.

(51) Int. Cl.
*B21D 53/06* (2006.01)
*B23P 15/26* (2006.01)

(52) U.S. Cl. ..... 29/890.048; 29/890.03; 29/890.031; 29/890.045; 29/890.049; 165/177; 165/184

(58) Field of Classification Search ..... 29/890.03, 29/890.031, 890.035, 890.045, 890.048, 29/890.049; 165/177, 184
See application file for complete search history.

(56) References Cited

U.S. PATENT DOCUMENTS 4,162,566 A * 7/1979 Webb ..... 29/890.035
4,224,984 A * 9/1980 Miyata et al. ..... 165/184
4,619,025 A * 10/1986 McManus et al. ..... 29/890.048
5,022,149 A * 6/1991 Abbott ..... 29/890.048
5,954,125 A * 9/1999 Mantegazza et al. ..... 165/149

* cited by examiner

*Primary Examiner* — Richard Chang
(74) *Attorney, Agent, or Firm* — Oakwood Law Group, LLP; Jie Tan

(57) ABSTRACT

A method of salvaging a scrap partially completed spine fin coil by initially placing the partially completed coil on a reel. Connecting an end of a straight tube that is helically wrapped with a spine fin strip to an end of the partially completed coil while said partially completed coil is on the reel, rotate the reel after completing the connection until the partially completed spine fin coil is complete.

20 Claims, 4 Drawing Sheets

FIG. 2
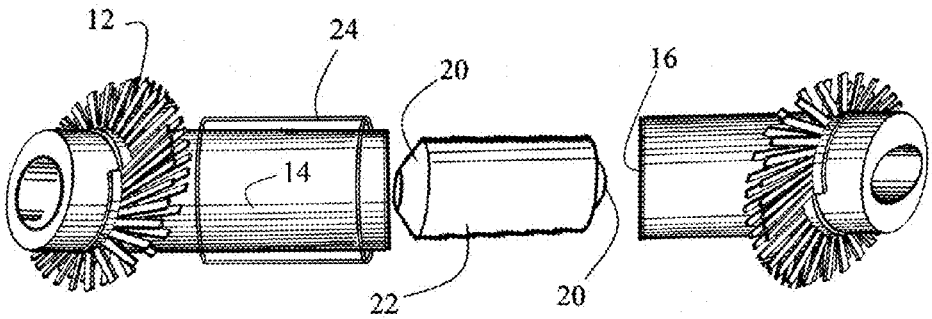
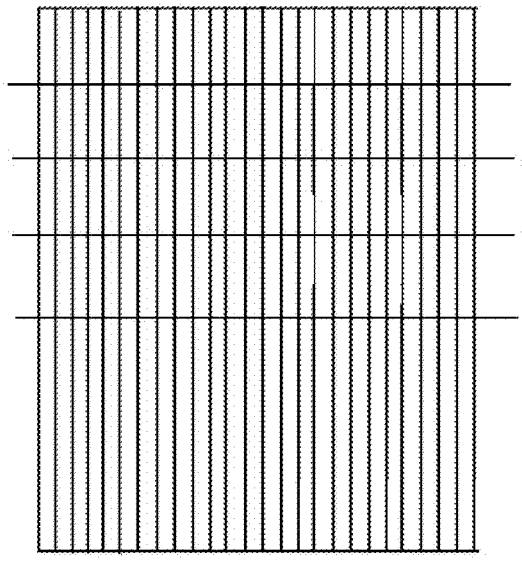
FIG. 3

HANDLING SPINE FIN COILS, WINDERS, REELS, SHAPERS AND/OR PROCESSING SPINE FIN AND TRANSITION TUBE SPLICING AND REWORK

REFERENCE TO RELATED APPLICATIONS

This patent application claims the benefit of U.S. Provisional Application No. 61/108,070 filed on Oct. 24, 2008, the disclosure of which is incorporated herein in its entirety by reference.

BACKGROUND OF THE INVENTION

1. Field of the Invention

The present invention relates broadly to the field of heat exchangers, and more specifically to a method for continuously forming spine fin coil type heat exchangers.

2. Description of Related Art

When manufacturing spine fin coils, and/or other coils for refrigeration systems, some coils are not completed for a variety of reasons. For example, the reel ran out of spine fin before the complete coil was finished, or the desired number of wraps was not completed before running out of spine fin on the reel.

There is a lot of waste involved in scraping a coil that is partially formed. When shaping a coil of spine fin, the spine fins are easily deformed and flattened as the coil is processed through the shaper that crushed the spine fin flat, which causes the air flow through the coil in a refrigerant system to be restricted.

It would be a decided advantage in the industry to salvage spine fin which is now considerer to be scrap and to reprocess the scrap spine fin into useable continuously form helically wound fin tube coils. Further, it would be advantageous if the device performing continuous helical formation from scrap were adaptable to form heat exchanger coils of almost any size with minimizing the pattern deformity of crushing the spine fins.

In the manufacturer of spine fin heat exchanger tubes it is common to form bends in the tubes at selected locations along its length by apply a force to the tube through the spine fin material to produce the bends. During the application of such force the spine fins at the bend are severely damaged and mutilated as the bend is formed. Therefore, it is desirable to provide apparatus and method which will control the pattern deformity and does hot crush the spine fins after forming bends in the shaper in the spine fin tubing but will reduce the damage and improve the process.

SUMMARY OF THE INVENTION

Spine fin coils, winder, reels shapers and/or other processes are provided to reduce and/or eliminate scrap and prevent the deformation of spine fins when forming a spine fin tube into a coil. These products are useful for a residential air conditioning unit and/or any refrigeration unit, and can use any and all useable spine fin tubing and can be processed on an adjustable shaper reel that is capable of expanding and/or retracting to different sizes to accommodate any size spine fin coil for reworking.

In an exemplary embodiment of the present invention, there is disclosed a permanent method of salvaging a scrap partially completed spine fin coil by initially placing a splice in the partially completed coil on a reel. Then an end of a straight tube that is helically wrapped with a spine fin strip is connected to an end of the partially completed coil while the partially completed coil is on the reel and, after completing the connection the reel is rotated until the partially completed spine fin coil is complete.

In another exemplary embodiment of the present invention, there is disclosed a permanent method of salvaging the spine fin of a scrap partially completed spine fin coil by initially placing a splice in the partially completed coil on a reel. Then an end of a straight tube that is helically wrapped with a spine fin strip is connected to an end of the partially completed coil while the partially completed coil is on the reel and, after completing the connection the reel is rotated until it is full. The spine fin on the full reel is now used to make a new coil.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

FIG. 2 is an expanded side view of the splice between the ends of two spine fin tubes shown in FIG. 1 is accordance with the principles of the invention;

FIG. 3 is a perspective view of a shaper for processing spine fin coils and using some and/or all of the principles of the invention controls are in place to reduce the pattern deformation of the fins using the pin type and/or blade, bridge and/or spring loaded movable slot, pivot type, action process;

DESCRIPTION OF THE PREFERRED EMBODIMENT

Helically wound spine fin coils are frequently used for heat exchangers in air conditioning units where the coils are formed around a mandrel having a rectangular or annular shape or any shape desired.

Figure 1:
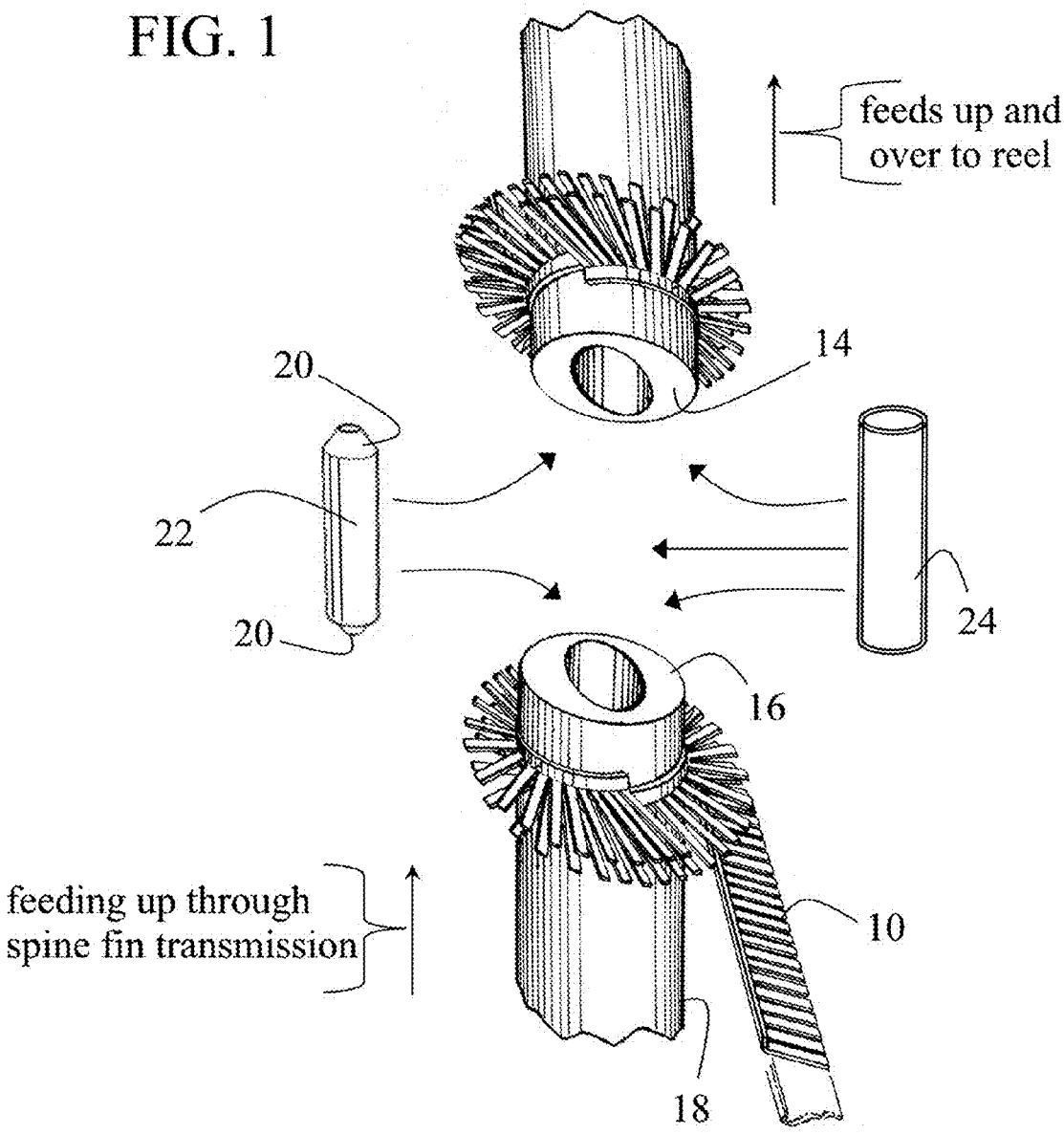
FIG. 1 is a perspective expanded view of a splice between the ends of two spine fin tubes is accordance with the principles of the invention.

When making a tube having a spine fin, a continuous length of spine fin strip 10 is initially wound around the outside surface of a substantially straight length of tube 12 as shown in FIG. 1. Then the length of tube with the spine fin is wound on a reel to form a cylindrical coil or is bent to form a coil having a rectangular shape where each revolution of the reel produces one wrap of the coil. Referring to FIG. 3, the blades can be in segments in different lengths where the lengths depend on a customer's needs. The segments can move as the coil bends into shape while the spine fin wrap on the tube is neither torn nor broken loose. The coil is comprised of a tube that is made of aluminum and the spine fin strip that surrounds the tube is also made of aluminum. The spine fin strip is used to remove heat from the tube. The ends of the spine fins of adjacent coils are positioned to just touch each other.

Currently, spine fins coils are manufactured in various steps. First, a spine fin machining wrapper is used to put the spine fins on to the outside surface of a tube. Then, if the coil is to have a square shape, the spine fin tube is transferred to a coil winder which makes the bends to form the shape. It is during this process when the coil is being shaped in the shaper that the spine fins on the inside corners of the coil being bent that the spine fins that are deformed and flattened.

When forming the coil from a round shape to square or similar shape, the outside and inside surfaces of the bend portion of the coil are pressed or bent to the desired shape. In this process the fins are mashed down at the four inside corners because the fins are delicate and are easily crushed. These crushed spine fins can cause an unwanted air flow restriction that, over time, can lead to a build up of dirt and debris which can cause an undesired air flow restriction.

Figure 4A:
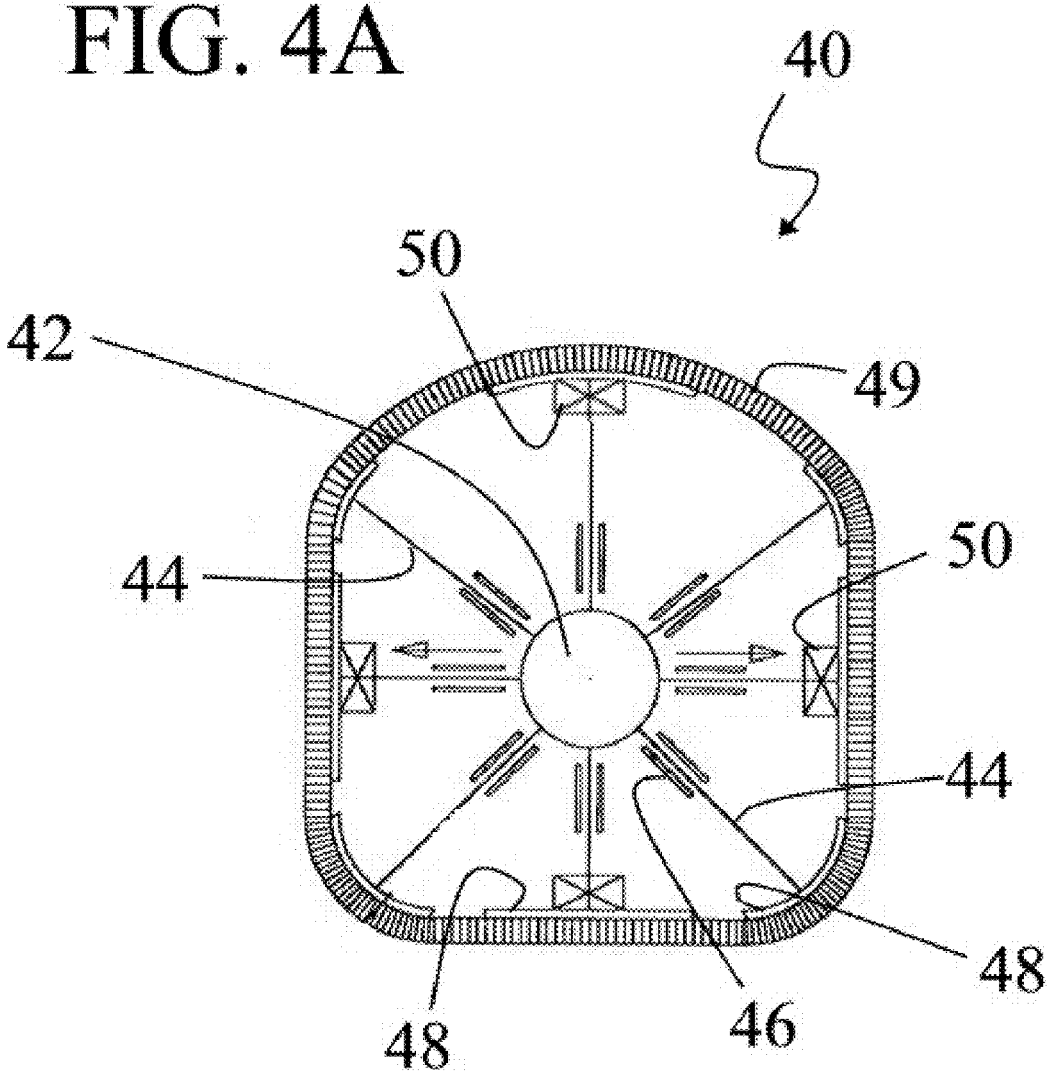
FIG. 4A is a side view of an adjustable reel for processing previously wasted spine fin in accordance with the principles of the invention.
Figure 4B:
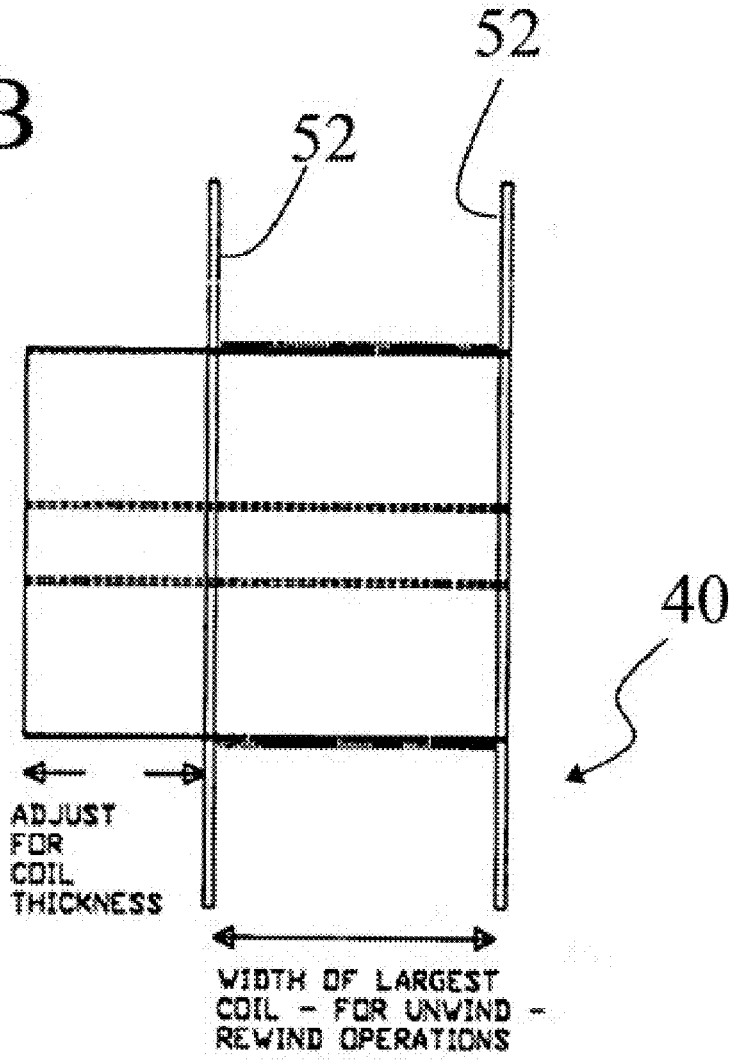
FIG. 4B is an end view of the adjustable reel of FIG. 4A for processing previously wasted spine fin in accordance with the principles of the invention.

Referring to FIGS. 4A and 4B there is shown an adjustable reel 40 which can be configured to receive a spine fin coil that has any shape from round to square and, when used as a shaper, can form coils having various shapes. With the shaper shown, when a square spine fin coil is formed, the spine fins on the inside corners of the coil will not be smashed, but controlled. The adjustable reel 40 has a center hub 42 which is coupled to and is controllably rotate by a variable speed drive motor, not shown.

Projecting outward from the center hub are eight arms 44, each of which is coupled to a pneumatically operated cylinder having a piston 46 which is adapted to selectively increase or decrease the lengths of the arms 44. In place of the pneumatically operated cylinder having a piston, any other mechanism such as an electrical motor coupled to operate a scissor lift mechanism or a screw mechanism can be used. Located at the outer end of each arm is a plate 48 which receives and supports the spine fin tube 49. The plates that are located at inside corners of the coil are curved to allow the spine fin tube to bend without crushing the spine fins on the inside of the bend. The surface can be spring loaded and/or have plates that pivot, slide up and down and/or move with the bending motion and are fully or partially loaded. Depending on the type and configurations of the plates and the lengths of the various arms, coils having a circular shape and coils having part circular and flat sides can be made. See FIG. 3.

The shaper shown can make a coil having three straight sides, one curved side and two rounded corners. The shape of coils that can be made with the adjustable shaper reel 40 is limited only by the number of arms that the shaper has and the type of plates that are on the ends of the arms. With the correct number of adjustable arms and cooperating plates, coils having eight or more sides can be made. In the areas of the coil where the spine fin coil is straight, the plates are straight. Located on opposing arms are counter weights 50. The counter weights are slidably attached to the arms and can be positioned along the arms to compensate for uneven weight distribution.

In operation, the arms are operated to raise or lower the plates to provide support for any shaped spine fin coil that is being wound onto the reel. When the spine fin coil is to be removed, the arms are retracted and the coil is pulled off the end of the mandrel. Looking at FIG. 4B, two side members 52 are provided to support the sides of coils that are being wound onto the adjustable rework reel. The sides of the reel are adjustable and can be moved closer together or further apart to receive partial coils of different sizes and the variable length arms and cooperating plates are adjustable to receive and/or make wraps of various shapes.

Coils are consider to be scrap because there was not enough spine fin tubing to make a complete coil, or there was not enough spine fin tubing to complete the desired number of wraps of the coil being made. However, in each instance the partial coil is scrapped which results in a waste of material and the time spent in making the scraped spine fin coil.

With the invention disclosed, a coil that is only partially completed can now be reworked and used to make a new useable spine fin coil.

Referring to FIGS. 1 and 2, there is shown a perspective expanded view and a side view of a splice between the ends of two spine fin tubes in accordance with the principles of the invention. This permanent connection can be made at the spine fin machines and will allow for a continuous feed of spine fin until the reel is full. Note, this will in and of itself eliminate most or all of the splice problems, with no splices in a reel.

A partially completed spine fin coil which is considered to be scrap and is to be discarded is placed on adjustable reel 40. While on the adjustable reel, the end 14 of the tube of the partially completed spine fin coil is spliced to an end 16 of a spine fin tube 18 of equal size. The splice made is a permanent splice which is made by either soldering or welding the two tubes of substantially equal size together where the tubes can be either copper or aluminum tubing.

Initially, to make an inside splice, the spine fins on the ends of each tube are removed and the use of tubing cutters is the best way to remove each end. The splice is an inside splice when the ends 20 of reduced diameter of a short length of a transition tube 22 are inserted into and soldered or welded to the ends 14, 16 of the spine fin tubes 12, 18 being connected together. Prior to inserting the ends of the transition tube into the ends 14, 16 of the spine fin tubes, a slip sleeve 24 is slid over the end of one of the tubes 12 or 18. The slip sleeve 24 has a length which allows its ends to overlap the ends 14, 16 of the tubes after the transition tube has been soldered or welded to the tubes. After the transition tube is soldered or welded to the ends of the tubes, the slip sleeve is slid over the transition tube and its ends are soldered of welded to the ends of the tubes 12, 18. The slip sleeve now completely covers the transition tube and provides additional strength to the splice. The sleeve is optional and can be used to provide extra rigidity to help throughout the processing phase.

In another embodiment the splice can be an outside splice, not shown, where the ends of a short length of a transition tube are fitted over the ends of the spine fin tubes being connected together. When making a splice with a transition tube that can be fitted over the ends of the spine fin tubes being connected together, the spine fin tubes can be cut to size with a tube cutter. It is understood that the spine fins at the ends of the tubes are removed to make the splice.

The splicing of the two spine fin tubes together is a permanent splice which is made at the spine fin machine and effectively eliminates scrap associated with making a temporary splice which is currently being made.

After the splice is made and the two tubes are connected, the reel 40 is operated to complete the coil or to fill the reel with spine fin tubing.

During the normal operation of making spine fin coils, partially completed coils are scrapped. This is a waste of time, money and material. With this invention, partially completed coils can be stored and, when a "down time" during the work week occurs, the partially completed coils which are currently consider to be scrap, can be spliced to a section of spine fin tubing and the coil can be completed for use at a later time or used as a replacement coil. Also, a person can be assigned to this task as a job has been created Now, for the first time, using the space between the table and the guide tube, all spine fin produce that are not complete coils can be presently spliced at the machine. The splice is made while the incomplete coil or tubing is being changed. Upon making the splice, the worker then continues to run the spine fin to the reel until the reel is full. An obvious result is that scrap is reduced to a minimum.

The method disclosed of making a permanent splice at the spine fin machine will allow a reel to hold a length of spine fin tubing which is sufficient for a continuous run when filling a coil It is here noted that the spine fin tubing is pliable enough that it can be placed on a reel and re-wound to make a coil of another size. Therefore, in an embodiment of the invention all useable spine fin coils which were only partially formed and not completed can now be completed and saved from the scrap pile by being removed from the winder and placed on an adjustable reel such as the reel of FIG. 4 which is capable of expanding and contracting to different sizes to accommodate all coil sizes that are to be reworked. The only time that the coil winder will come to an end is when the reel runs out of spine fin tubing on their reel.

While on the adjustable reel, the end of the spine fin tube is spliced, by soldering or welding, to an end to a straight section of spine fin tubing of similar size. After the splice is completed, the adjustable reel is operated until the straight spine fin tubing that was just spliced to the spine fin coil fills the adjustable reel. Now, using the spine fin tubing on the adjustable reel, new coils having a desired size and length with the right amount of wraps for the size and shape of a coil that is now desired can be made. Thus, the coil of spine fin tubing which was considered to be unusable and scrap is reworked to become a new useful product.

The shaping or other handling equipment used can have the pin type or blade type offsetting extensions that allow spine fin tubing to be reworked without the pattern deformity that is manufactured into each coil and will allow the coil to be rework. The pins or blades can be made of different materials and/or can be any shape or size such as being set at an angle or a combination of angles. The ends of the pins or blades can be any shape needed. The pins can even rotate about a pivot point. Even though some of the fins may be moved from their original position, they will not be worse than the pattern deformity they have with all four inside corners being smashed flat which causes a restriction to the air flow and an extra load on the condensing coil fan motor.

What is disclosed is a new and improver method of salvaging uncompleted spine fin coils. In one embodiment an uncompleted coil is placed on an adjustable reel and, while on the adjustable reel, it is spliced to a spine fin coil of the same size and the adjustable reel is operated to complete the coil. In another embodiment an uncompleted coil is placed on an adjustable reel and, while on the adjustable reel, it is spliced to a spine fin coil of the same size. Thereafter, the adjustable reel is operated until the reel is full. The spine fin tubing that was initially placed on the adjustable reel is pliable enough that it can be reworked to make a coil of another size. Therefore, the spine fin tubing that is now on the adjustable reel can be used to make totally new coils.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A method of salvaging a scrap partially completed spine fin coil comprises:

placing the partially completed coil on a reel;

connecting an end of a straight tube helically wrapped with a spine fin strip to an end of the partially completed coil while said partially completed coil is on the reel; and rotating the reel after completing the connection of an end of the straight tube helically wrapped with a spine fin strip to the end of the partially completed coil to continue forming the partially completed spine fin coil until the partially completed spine fin coil is complete.

2. The method of claim 1 wherein said reel shapes the straight tube helically wrapped with a spine fin strip to the shape of the partially completed coil as the reel is rotated.

3. The method of claim 2 wherein the connection between the ends of the straight tube helically wrapped with a spine fin strip to an end of the partially completed coil is with an internal splice which is done at a spine fin machine before said partially completed coil is placed on a new reel.

4. The method of claim 2 wherein the connection between the ends of the straight tube helically wrapped with a spine fin strip to an end of the partially completed coil is with an external splice.

5. The method of claim 3 wherein said internal splice is made by soldering or welding.

6. The method of claim 4 wherein said external splice is made by soldering or welding.

7. The method of claim 2 wherein said reel is capable of expanding and contracting to different sizes to accommodate all coil sizes that are to be reworked.

8. The method of claim 7 wherein said reel or a rework reel includes variable length arms and plates coupled to the variable length arms for receiving a partially completed coil.

9. The method of claim 7 wherein the length of said variable length arms is controlled by pneumatically or electrically operated means or other apparatus.

10. The method of claim 9 wherein plates are coupled to the ends of said variable length arms which mirror the shape of the wraps of the coil.

11. The method of claim 9 wherein said plates are curved and flat.

12. The method of claim 10 wherein said plates are pivotly coupled to the ends of said variable length arms.

13. The method of claim 10 wherein at least one balancing weight is coupled to at least one variable length arm.

14. The method of claim 13 wherein said at least one balancing weight is movable along the variable length arm.

15. A method of salvaging a scrap partially completed spine fin coil comprises:

placing the partially completed coil on a reel;

connecting an end of a straight tube helically wrapped with a spine fin strip to an end of the partially completed coil while said partially completed coil is on the reel; and rotating the reel after completing the connection of an end of the straight tube helically wrapped with a spine fin strip to the end of the partially completed coil until the reel is full.

16. The method of claim 15 wherein the connection between the ends of the straight tube helically wrapped with a spine fin strip to an end of the partially completed coil is with an internal splice which is done at a spine fin machine before said partially completed coil is placed on a new reel.

17. The method of claim 15 wherein the connection between the ends of the straight tube helically wrapped with a spine fin strip to an end of the partially completed coil is with an external splice.

18. The method of claim 16 wherein said internal splice is made by soldering or welding.

19. The method of claim 17 wherein said external splice is made by soldering or welding.

20. The method of claim 14 further comprises:

using the spine fin on the reel to make a totally new coil.

* * * * *